United States Patent [19]

Yamada

[11] Patent Number: 4,744,564

[45] Date of Patent: May 17, 1988

[54] GOLF BALL

[75] Inventor: Kaname Yamada, Kakogawa, Japan

[73] Assignee: Sumitomo Rubber Industries, Ltd., Hyogo, Japan

[21] Appl. No.: 871,220

[22] Filed: Jun. 6, 1986

[30] Foreign Application Priority Data

Jun. 7, 1985 [JP] Japan ..... 60-124644

[51] Int. Cl.[4] ..... A63B 37/14

[52] U.S. Cl. ..... 273/232

[58] Field of Search ..... 273/232

[56] References Cited

U.S. PATENT DOCUMENTS

| | | | |
|---|---|---|---|
| 3,819,190 | 6/1974 | Nepela et al. | 273/232 |
| 4,090,716 | 5/1978 | Martin et al. | 273/232 |
| 4,284,276 | 8/1981 | Worst | 273/232 |
| 4,560,168 | 12/1985 | Aoyama | 273/232 |

FOREIGN PATENT DOCUMENTS

| | | | |
|---|---|---|---|
| 2150840A | 7/1985 | United Kingdom | 273/232 |
| 2157959A | 11/1985 | United Kingdom | 273/232 |
| 2162760A | 2/1986 | United Kingdom | 273/232 |

*Primary Examiner*—George J. Marlo

*Attorney, Agent, or Firm*—Armstrong, Nikaido, Marmelstein & Kubovcik

[57] ABSTRACT

A golf ball having dimples on its spherical surface, the dimples close to each pole being smaller in volume than those close to the parting line while maintaining total effectiveness of dimple volume substantially equal in relation to a first axis passing through the center of the ball defining a pair of poles and to a second axis passing through the center of the ball perpendicular to the first axis, so as to minimize variations in the aerodynamic characteristics of the ball despite changes of the axis of rotation. The effectiveness of dimple volume means a product obtained by multiplying the volume of a dimple by the sine value of an angle made by a radius from the center of the ball to the center of that dimple and the first or second axis of the ball.

11 Claims, 8 Drawing Sheets

NUMBER OF DIMPLES 392

NUMBER OF DIMPLES 392

GOLF BALL

TECHNICAL FIELD

The present invention relates to improvements in golf balls.

PRIOR ART

Various proposals have heretofore been made as to the pattern and shape of dimples in golf balls. Golf balls are divided generally into the following six types according to the dimple pattern.

(1) Those having about 336 dimples in a regular octahedral arrangement.

(2) Those having 360 dimples in a regular dodecahedral arrangement (Examined Japanese Patent Publication No. SHO 57-22595).

(3) Those having 320 dimples equidistantly arranged at a constant center-to-center spacing (equal pitch arrangement) (Unexamined Japanese Patent Publication No. SHO 57-107170).

(4) Those having 252 or 492 dimples in a quasi-icosahedral arrangement (Unexamined Japanese Patent Publication No. SHO 49-52029).

(5) Those having 332 or 392 dimples in a quasi-icosahedral arrangement (Examined Japanese Patent Publication No. SHO 58-50744).

(6) Those having 280 to 350 dimples arranged on concentric circles centered about the opposite poles (concentric circular arrangement) (Unexamined Japanese Patent Publication No. SHO 53-115330).

In any of the arrangements of dimples mentioned above, the dimples on the spherical surface of the ball are all of the same dimension (volume), and none of the dimples have different dimension (volumes) at different portions of the spherical surface.

It is required that the golf ball exhibit the same flight characteristics from whatever direction it may be hit. That is, the ball must always behave with spherical symmetry when hit with different axes of rotation (as prescribed in Rules of Japan Golf Association, Supplementary Rule III, Ball (C) and also in like rules of U.S. Golf Association). In other words, it is required that the golf ball exhibit definite aerodynamic characteristics when hit with any optional axis of rotation.

Of the foregoing dimple patterns, (1), (2) and (3) are based on a polyhedral arrangement, have a plurality of planes of symmetry and are excellent in the uniformity of arrangement, number and dimension of dimples (that is, the ball surface is excellent in equivalency to a spherical surface), so that the variations in the aerodynamic characteristics due to changes of the axis of rotation of the ball are small.

However, the fabrication of golf balls involves the problem that since the golf ball is molded using a pair of upper and lower dies, dimples can not be arranged at the junction of the dies (i.e., on the parting line to be mentioned below). Accordingly, even if it is attempted to design a highly symmetric dimple arrangement, there are cases wherein the symmetry is sacrificed.

The arrangements (4), (5) and (6) are typical of such cases; each of these arrangement has only one plane of symmetry through the parting line and is therefore low in equivalency to a spherical surface (roundness). Consequently, if dimples of the same dimension are arranged over the entire ball surface, changes of the axis of rotation of the ball result in variations of aerodynamic characteristics. Thus, it is impossible to obtain the desired flight performance with stable directionality. It is therefore undesirable to arrange dimples of identical dimension (volume) in the case of dimple arrangements having a small number of planes of symmetry.

SUMMARY OF THE INVENTION

The main object of the present invention is to provide a golf ball which, even having a dimple arrangement of a small number of planes of symmetry, is adapted to exhibit definite aerodynamic characteristics despite changes of the axis of rotation of the ball, by ingeniously designing the dimension of individual dimples.

To fulfill the above object, not all dimples of the golf ball of the present invention are uniform in volume, and when dimples in optional positions are compared, the volume of the dimple closer to either pole is smaller than or equal to the volume of the dimple closer to the parting line.

DETAILED DESCRIPTION OF THE INVENTION

Figure 1:
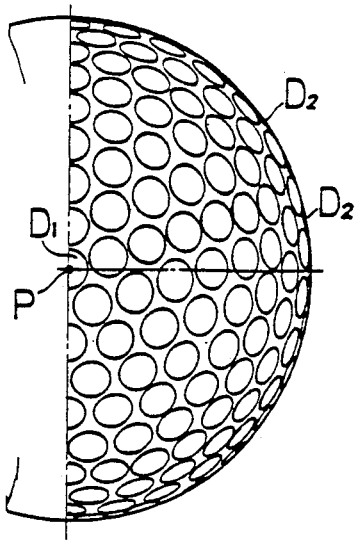
FIG. 1 is a front view showing a first embodiment.
Figure 2:
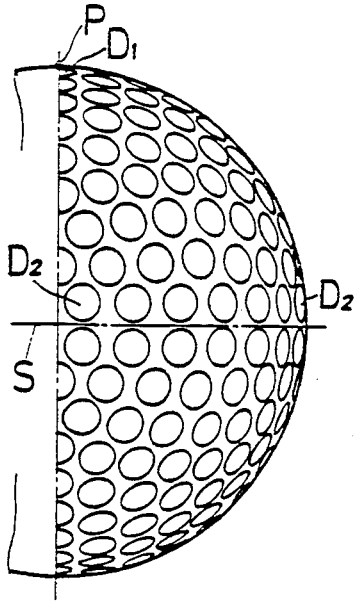
FIG. 2 is a plan view of the same.
Figure 3:
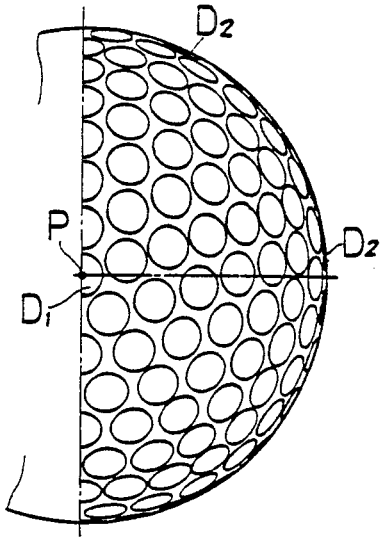
FIG. 3 is a front view of a second embodiment.
Figure 4:
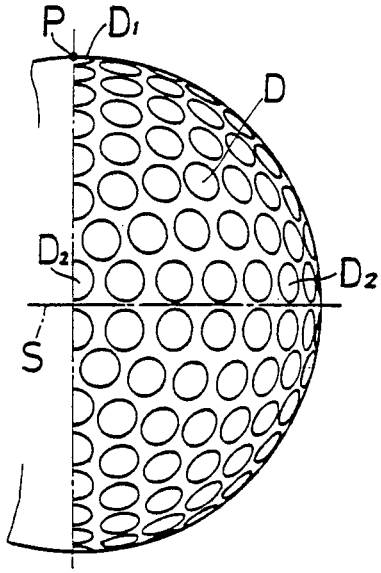
FIG. 4 is a plan view of the same.
Figure 5:
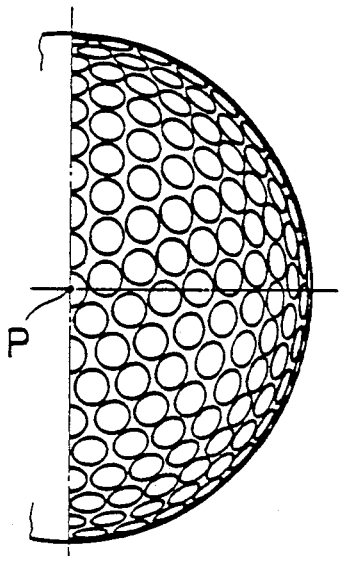
FIG. 5 is a front view of a third embodiment.
Figure 6:
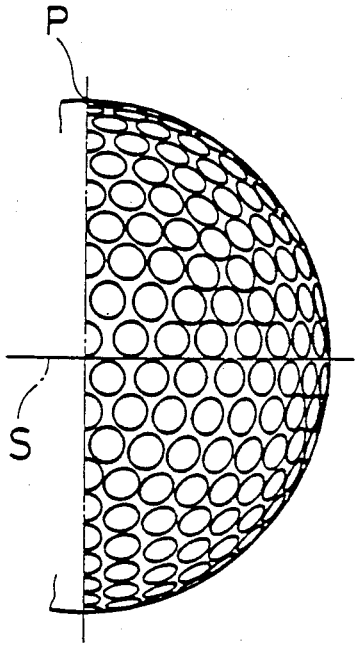
FIG. 6 is a plan view of the same.
Figure 7:
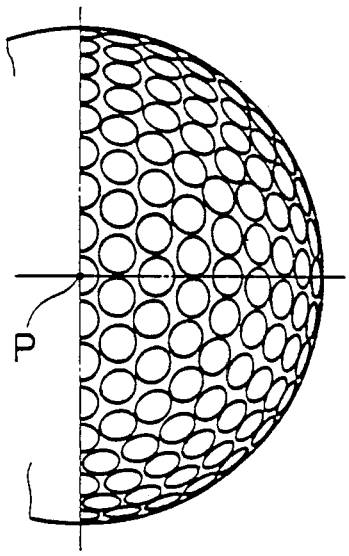
FIG. 7 is a front view of a fourth embodiment.
Figure 8:
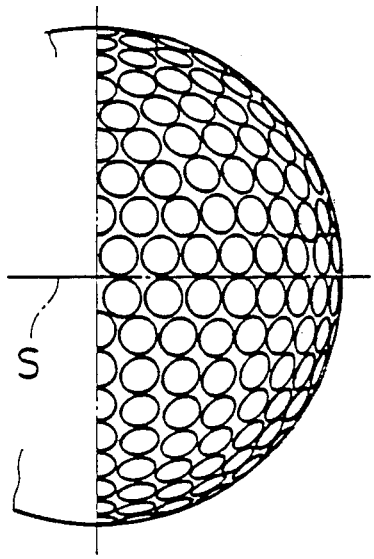
FIG. 8 is a plan view of the same.
Figure 9:
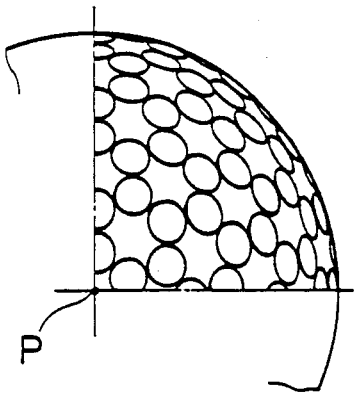
FIG. 9 is a front view of a first reference example.
Figure 10:
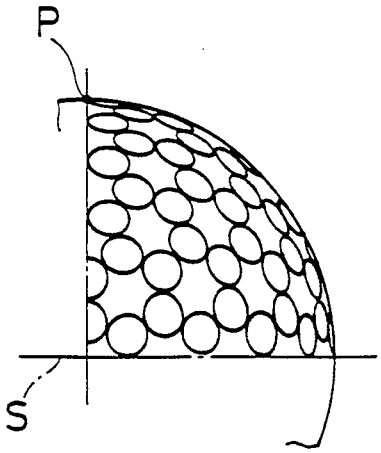
FIG. 10 is a plan view of the same.
Figure 11:
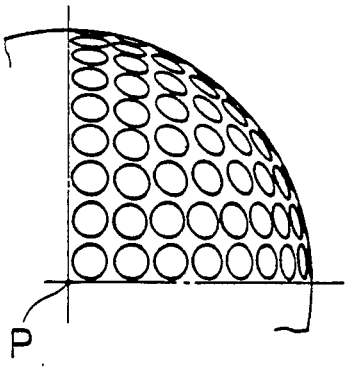
FIG. 11 is a front view of a second reference example.
Figure 12:
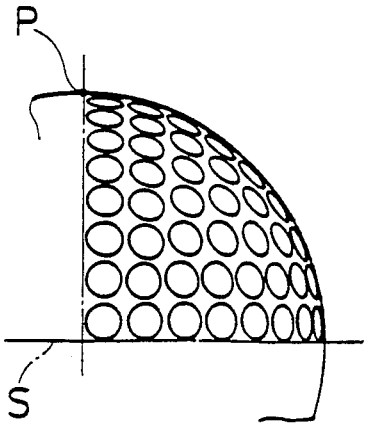
FIG. 12 is a plan view of the same.
Figure 13:
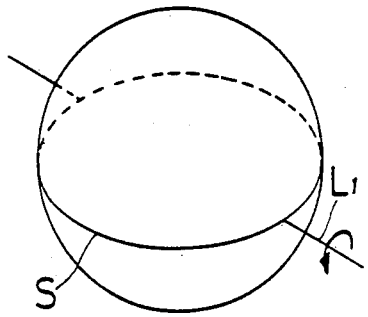
FIG. 13 is a diagram for illustrating "POP"
Figure 14:
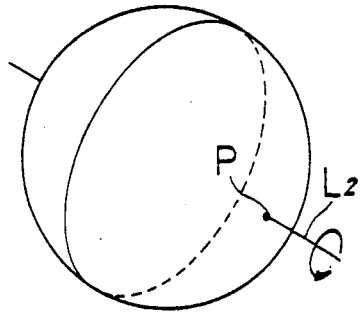
FIG. 14 is a diagram for illustrating "PH"

As is known for a long time, the arrangement, dimension, etc. of dimples are important for the flight of the golf ball. These factors are used for controlling the lift characteristics, etc. We checked the flight characteristics of balls having dimples in an asymmetric arrangement (as shown in FIGS. 1 to 8, etc. to be described later) and found that a greater lift and higher trajectory can be obtained when the ball is hit with rotation about an axis L1 through the seam (parting line) S as shown in FIG. 13 (pole over pole or "POP" rotation) than when it is hit with rotation about an axis L2 through the poles P as shown in FIG. 14 (pole horizontal or "PH" rotation). (Comparative Examples 11, 12, 13 and 14 given later show that POP achieves a longer duration of flight than PH.)

Presumably, the reason is that with the above arrangement, the effect of the dimples is greater in POP direction than in PH direction. We assumed that elimination of the variations in the dimple effect will be directly effective for obviating the variations in the flight characteristics of the ball, and introduced the concept of total effectiveness of dimple volume in order to substantiate the assumption.

The total effectiveness of dimple volume means a volume obtained by multiplying the sine value of an angle made by a straight line through the center of the dimple in an optional position and the center of the ball with the axis of rotation, by the volume of the dimple in the optional position. Thus, the effect of dimples is analyzed based on the effect of the dimple on the axis of rotation of the ball which is taken as a minimum of zero and the effect of a dimple on the large circle of rotation which is taken as a maximum of 1.

When the total effectiveness of dimple volumes of balls having an asymmetric arrangement (FIGS. 1 to 8, etc.) of dimples of uniform dimension are calculated in POP and PH directions, the effective total volume of each ball is greater in POP direction as shown in Comparative Examples 11 to 14. To substantiate the above assumption, we conducted experiments using balls in which without changing the total volume of the dimples, dimples closer to the pole which are more effective in POP direction in respective of effective volume were made smaller in volume than those closer to the parting line, with dimples closer to the parting line made correspondingly larger in volume. Consequently, the assumption was verified.

The effect of the dimples will be clarified with reference to the following embodiments and the data thereof.

EMBODIMENTS

In the drawings of embodiments of golf balls, dimples are shown over a quarter area of the ball surface.

Table 1 below shows examples of the invention. Table 1 sets forth the dimple design and flight characteristics of the examples of applicants' invention. Table 2 shows comparative examples. Table 2 sets forth the dimple design and flight characteristics of examples known in the prior art. In each comparative example, the dimples are all identical in dimension and are arranged in the same pattern as the corresponding example of the invention as will be mentioned later. Table 3 shows an arrangement of dimples 392 in total number, with the position of each dimple expressed in terms of angle $\theta$ (theta) and angle $\phi$ (phi) these angles being defined on page 9 herein.

The terms in the following tables and description have the following meanings.

DIMPLE VOLUME

The volume of the cavity portion (shown by hatching in FIG. 15) beneath a horizontal plane containing the dimple edge. When the dimple is defined by a portion of a perfect sphere, the volume, V, is expressed by:

$$V=\pi d1^2\{R-d1/3\}$$

wherein d1 = depth from the dimple edge

R = radius of the dimple sphere.

RATIO OF TOTAL EFFECTIVENESS OF DIMPLE VOLUME

The ratio of the total effectiveness of the dimple volume (A) in POP direction to the total effectiveness of dimple volume (B) in PH direction, expressed by:

$$|(A/B-1)\times 100|(\%)$$

CONVERTED DIMPLE DEPTH

Figure 15:
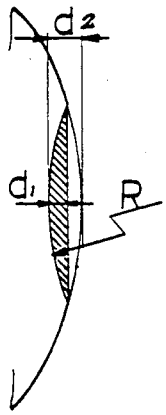
FIG. 15 is a diagram for illustrating a dimple portion.
Figure 16:
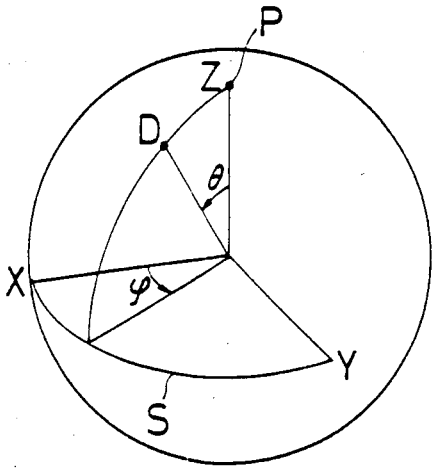
FIG. 16 is a diagram for illustrating how to express the position of a dimple.
Figure 17:
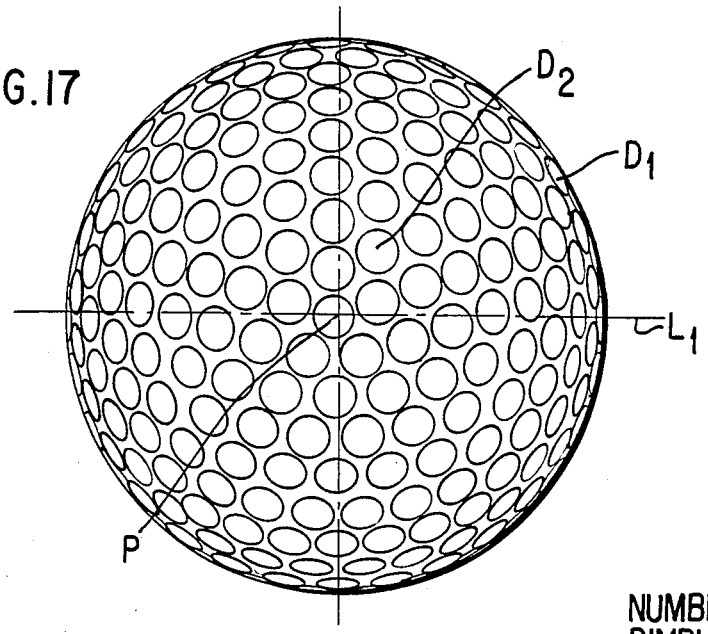
FIG. 17 is a front view of an embodiment having 392 dimples.
Figure 18:
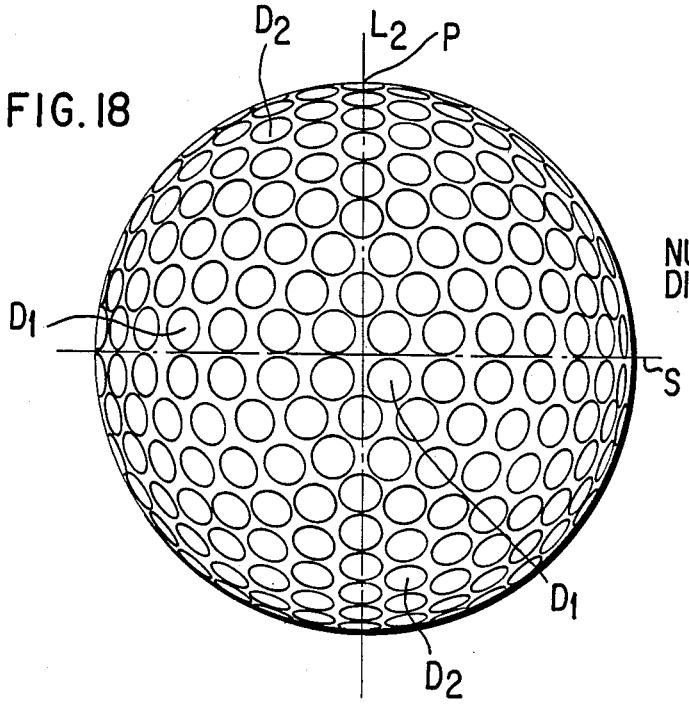
FIG. 18 is a plan view of an embodiment having 392 dimples.
Figure 19:
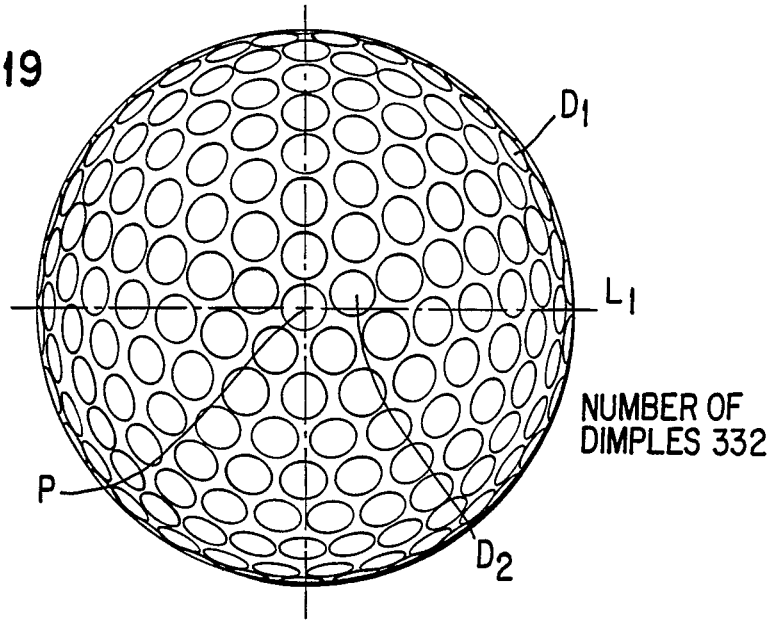
FIG. 19 is a front view of an embodiment having 332 dimples.
Figure 20:
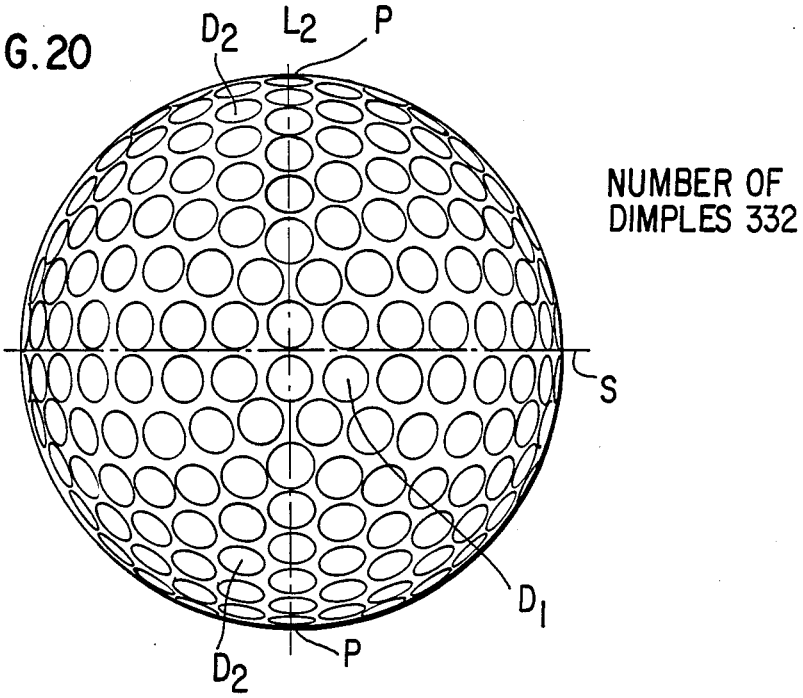
FIG. 20 is a plan view of an embodiment having 332 dimples.
Figure 21:
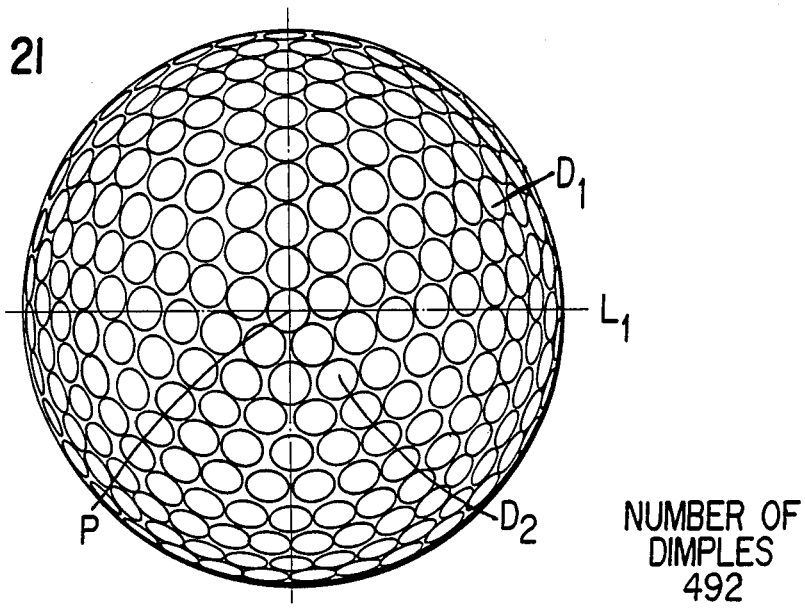
FIG. 21 is a front view of an embodiment having 492 dimples.
Figure 22:
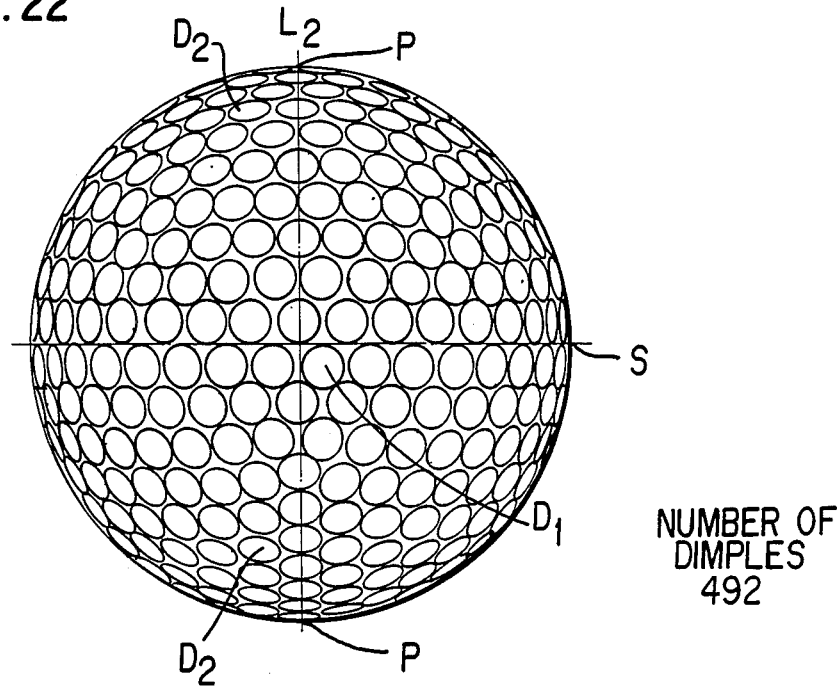
FIG. 22 is a plan view of an embodiment having 492 dimples.
Figure 23:
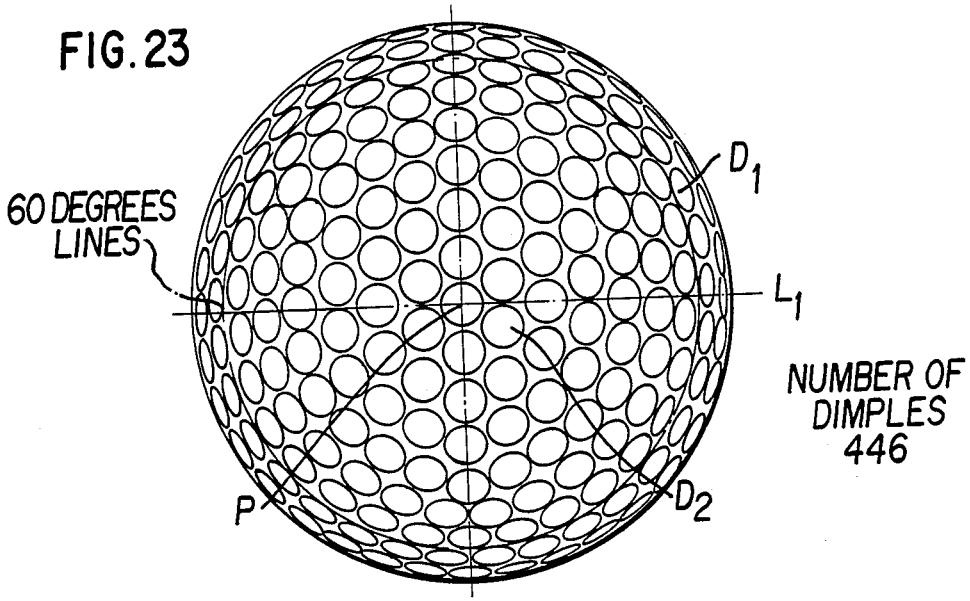
FIG. 23 is a front view of an embodiment having 446 dimples.
Figure 24:
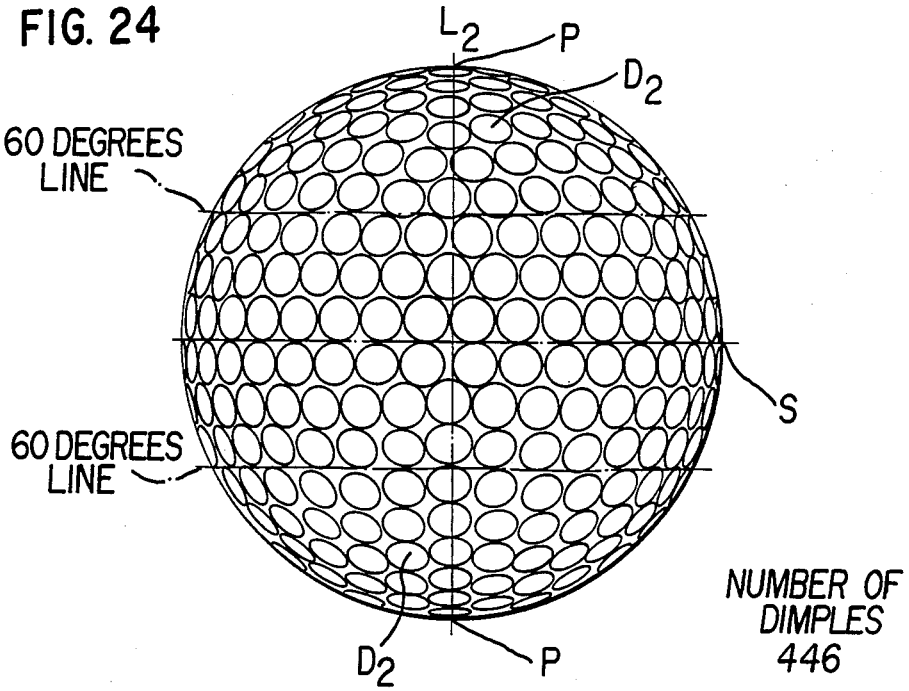
FIG. 24 is a plan view of an embodiment having 446 dimples.

The depth of the dimple as measured from the top of a phantom extension of the spherical ball surface to the bottom of the dimple and indicated at d2 in FIG. 15.

FLIGHT DISTANCE TEST

The same hitting test machine as used by U.S. Golf Associattion (USGA) for flight distance tests was used with a No. 1 wood club set thereon for hitting the ball at 48.8 m/sec (160 ft/sec). For each kind of ball, 20 samples were hit twice in each of POP and PH directions. The test result is given in terms of the average of the distances measured.

CARRY

The distance of flight of the ball from the hitting point to the point where the ball hit the ground.

RUN

The distance the ball rolled along from the ground hitting point to the point where the ball stopped.

TOTAL

The total distance which is carry plus run.

ANGLES $\theta$ and $\phi$

Suppose the ball has a three-dimensional coordinate system including Z-axis through the pole and the center of the ball, and X-axis and Y-axis on the plane containing the parting line. In this coordinate system, the position of a dimple D is indicated by $(\theta,\phi)$.

The angles $\theta$ and $\phi$ are counterclockwise angles from Z-axis and X-axis, respectively. The pole has an angle $\theta$ of 0 deg, and a point on the parting line S has an angle $\theta$ of 90 deg.

TABLE 1

| | Examples of the Invention Specimen Nos. | | | | | | | |
|---|---|---|---|---|---|---|---|---|
| | 1 | | 2 | | 3 | | 4 | |
| | Back-spin Direction | | | | | | | |
| | POP | PH | POP | PH | POP | PH | POP | PH |
| Total Number of Dimples | 392 | | 332 | | 492 | | 446 | |
| Dimple Diameter (mm) | 3.50 | | 3.80 | | 3.30 | | 3.55 | |
| Total Dimple Volume ($mm^3$) | 349 | | 390 | | 321 | | 345 | |

TABLE 1-continued

| | Examples of the Invention Specimen Nos. | | | | | | | |
|---|---|---|---|---|---|---|---|---|
| | 1 | | 2 | | 3 | | 4 | |
| | Back-spin Direction | | | | | | | |
| | POP | PH | POP | PH | POP | PH | POP | PH |
| Effective Total Volume ($mm^3$) | 277 | 277 | 309 | 309 | 252 | 252 | 272 | 272 |
| Effective Total Dimple Volume Ratio | | 0% | | 0% | | 0% | | 0% |
| Converted Dimple Depth | | | | | | | | |
| 0 ≦ 60° | 0.247 | | 0.279 | | 0.211 | | 0.228 | |
| 0 > 60° | 0.269 | | 0.302 | | 0.221 | | 0.232 | |
| Volume Ratio of Dimples Having 0 > 60° to Dimples Having 0 ≦ 60° | | 1.13 | | 1.12 | | 1.07 | | 1.02 |
| Flight Distance Test | | | | | | | | |
| Carrying Distance (m) | 218.4 | 218.8 | 217.4 | 217.8 | 219.4 | 219.1 | 218.2 | 218.4 |
| RunningDistance (m) | 18.0 | 17.8 | 16.1 | 15.8 | 18.1 | 18.0 | 18.7 | 18.4 |
| Total Distance (m) | 236.4 | 236.6 | 233.5 | 233.6 | 237.5 | 237.1 | 236.9 | 236.8 |
| Flight Duration (sec.) | 5.93 | 5.90 | 5.93 | 5.91 | 5.99 | 6.01 | 5.94 | 5.96 |

TABLE 2

| | Comparative Examples Specimen Nos. | | | | | | | |
|---|---|---|---|---|---|---|---|---|
| | 11 | | 12 | | 13 | | 14 | |
| | Back-spin Direction | | | | | | | |
| | POP | PH | POP | PH | POP | PH | POP | PH |
| Total Number of Dimples | 392 | | 332 | | 492 | | 446 | |
| Dimple Diameter (mm) | 3.50 | | 3.80 | | 3.30 | | 3.55 | |
| Total Dimple Volume ($mm^3$) | 350 | | 390 | | 320 | | 345 | |
| Effective Total Volume ($mm^3$) | 279 | 273 | 312 | 305 | 254 | 250 | 272 | 271 |
| Effective Total Dimple Volume Ratio | | 2.2% | | 2.3% | | 1.6% | | 0.4% |
| Converted Dimple Depth | | | | | | | | |
| 0 ≦ 60° | 0.257 | | 0.291 | | 0.216 | | 0.230 | |
| 0 > 60° | | | | | | | | |
| Volume Ratio of Dimples Having 0 > 60° to Dimples Having 0 ≦ 60° | | 1 | | 1 | | 1 | | 1 |
| Flight Distance Test | | | | | | | | |
| Carrying Distance (m) | 215.3 | 218.1 | 214.6 | 217.7 | 216.4 | 218.2 | 216.7 | 217.9 |
| Running Distance (m) | 15.3 | 18.3 | 13.4 | 15.7 | 12.1 | 15.0 | 14.8 | 16.1 |
| Total Distance (m) | 230.6 | 236.4 | 228.0 | 233.4 | 228.5 | 233.2 | 231.5 | 234.0 |
| Flight Duration (sec.) | 6.00 | 5.77 | 6.05 | 5.80 | 6.14 | 5.99 | 5.96 | 5.90 |

TABLE 3

| Theta | Phi-1 | Phi-2 | Phi-3 | Phi-4 | Phi-5 |
|---|---|---|---|---|---|
| 84.900 | 6.000 | 18.000 | 30.000 | 42.000 | 54.000 |
| 84.900 | 66.000 | 78.000 | 90.000 | 102.000 | 114.000 |
| 84.900 | 126.000 | 138.000 | 150.000 | 162.000 | 174.000 |
| 84.000 | 186.000 | 198.000 | 210.000 | 222.000 | 234.000 |
| 84.900 | 246.000 | 258.000 | 270.000 | 282.000 | 294.000 |
| 84.900 | 306.000 | 318.000 | 330.000 | 342.000 | 354.000 |
| 76.840 | 0.000 | 72.000 | 144.000 | 216.000 | 288.000 |
| 76.600 | 12.000 | 59.600 | 84.000 | 131.600 | 156.000 |
| 76.600 | 203.600 | 228.000 | 275.600 | 300.000 | 347.600 |
| 75.740 | 24.000 | 48.000 | 96.000 | 120.000 | 168.000 |
| 75.740 | 192.000 | 240.000 | 264.000 | 312.000 | 336.000 |
| 74.870 | 36.000 | 108.000 | 180.000 | 252.000 | 324.000 |
| 68.200 | 6.510 | 65.490 | 78.510 | 137.490 | 150.510 |
| 68.200 | 209.490 | 222.510 | 281.490 | 294.510 | 353.490 |
| 66.240 | 18.050 | 53.950 | 90.050 | 125.950 | 162.050 |
| 66.240 | 197.950 | 234.050 | 269.950 | 306.050 | 341.950 |
| 65.160 | 29.730 | 42.270 | 101.730 | 114.270 | 173.730 |
| 65.160 | 186.270 | 245.730 | 258.270 | 317.730 | 330.270 |
| 59.970 | 0.000 | 72.000 | 144.000 | 216.000 | 288.000 |
| 57.330 | 11.550 | 60.450 | 83.550 | 132.450 | 155.550 |
| 57.320 | 204.450 | 227.550 | 276.450 | 299.550 | 348.450 |
| 55.670 | 23.620 | 48.380 | 95.620 | 120.380 | 167.620 |
| 55.670 | 192.380 | 239.620 | 264.380 | 311.620 | 336.380 |
| 55.100 | 36.000 | 108.000 | 180.000 | 252.000 | 324.000 |
| 49.980 | 0.000 | 72.000 | 144.000 | 216.000 | 288.000 |
| 46.950 | 13.660 | 58.330 | 85.660 | 130.330 | 157.660 |
| 46.950 | 202.330 | 229.660 | 274.330 | 301.660 | 346.330 |
| 45.860 | 28.500 | 43.500 | 100.500 | 115.500 | 172.500 |
| 45.860 | 187.500 | 244.500 | 259.500 | 316.500 | 331.500 |
| 39.990 | 0.000 | 72.000 | 144.000 | 216.000 | 288.000 |
| 36.450 | 17.110 | 54.890 | 89.110 | 126.890 | 161.110 |
| 36.450 | 198.890 | 233.110 | 270.890 | 305.110 | 342.890 |

TABLE 3-continued

| Theta | Phi-1 | Phi-2 | Phi-3 | Phi-4 | Phi-5 |
|---|---|---|---|---|---|
| 35.340 | 36.000 | 108.000 | 180.000 | 252.000 | 324.000 |
| 29.990 | 0.000 | 72.000 | 144.000 | 216.000 | 288.000 |
| 26.435 | 23.050 | 48.950 | 95.050 | 120.950 | 167.050 |
| 26.435 | 192.950 | 439.050 | 264.950 | 311.050 | 336.950 |
| 19.990 | 0.000 | 72.000 | 144.000 | 216.000 | 288.000 |
| 16.860 | 36.000 | 108.000 | 180.000 | 252.000 | 324.000 |
| 9.990 | 0.000 | 72.000 | 144.000 | 216.000 | 288.000 |
| 0.000 | 0.000 | | | | |

FIRST EMBODIMENT (FIGS. 1 AND 2)

This embodiment is a thread-wound balata-covered ball of 1.68 inch (42.67 mm) diameter having 392 dimples in the same arrangement as the conventional arrangement (5).

Without changing the total dimple volume, dimples D2 closer to the parting line S are made deeper and dimples D1 closer to each pole P are made shallower so that the effectiveness of total dimple volume in POP direction is equal to that in PH direction.

The dimple diameter is 3.50 mm, the converted dimple depth is 0.247 mm at positions with an angle $\theta$ of up to 60 deg or 0.269 mm at positions with $\theta$ of greater than 60 deg, the total dimple volume is 349 $mm^3$, and the effectiveness of total volume is 277 $mm^3$ in both POP and PH. Between POP and PH, the difference in carry is 0.4 m, and the difference in duration of flight is 0.03 sec.

The ball of Comparative Example 11 is identical with the first embodiment in dimple arrangement, dimple diameter and total dimple volume, but all dimples have the same depth. Between POP and PH, the difference in carry is 2.8 m, and the difference in duration of flight is 0.23 sec.

Although the first embodiment is 0.13 sec longer than Comparative Example 11 in duration of flight in PH, there is no difference in total distance. This is considered to be one of the effects resulting from the approximately equal effectiveness of total dimple volumes for POP and PH.

SECOND EMBODIMENT (FIGS. 3 AND 4)

This embodiment is a thread-wound balata-covered ball of large size having 332 dimples in the same arrangement as the conventional arrangement (5).

The effective total volume is 309 $mm^3$ in both POP and PH.

The dimple diameter is 3.80 mm, the converted dimple depth is 0.279 mm at positions with an angle $\theta$ of up to 60 deg or 0.302 mm at positions with an angle $\theta$ of greater than 60 deg, and the total dimple volume is 390 $mm^3$. Between POP and PH, the difference in carry is 0.4 m and the difference in duration of flight is 0.02 sec.

The ball of Comparative Example 12 is identical with the second embodiment in dimple arrangement, dimple diameter and total dimple volume, but all dimples have the same depth. Between POP and PH, the difference in carry is 3.1 m, and the difference in duration of flight is 0.25 sec, hence great differences. The equal total effectiveness of dimple volume according to the second embodiment achieve an apparent effect.

THIRD EMBODIMENT (FIGS. 5 AND 6)

This embodiment is a thread-wound balata-covered ball of large size having 492 dimples in the same arrangement as the conventional arrangement (4).

The total effectiveness of dimple volume is 252 $mm^3$ in both POP and PH.

The dimple diameter is 3.30 mm, the converted dimple depth is 0.211 mm at positions with an angle $\theta$ of up to 60 deg or 0.221 mm at positions with an angle $\theta$ of greater than 60 deg, and the total dimple volume is 321 $mm^3$. Between POP and PH, the difference in carry is 0.3 m, and the difference in duration of flight is 0.02 sec.

The ball of Comparative Example 13 is identical with the third embodiment in dimple arrangement, dimple diameter and total dimple volume, but all the dimples are made to have the same depth. Between POP and PH, the difference in carry is 1.8 m, and the difference in duration of flight is 0.15 sec.

The equal total effectiveness of dimple according to the third embodiment achieve an apparent effect.

FOURTH EMBODIMENT (FIGS. 7 AND 8)

This embodiment is a thread-wound balata-covered golf ball having 446 dimples with a diameter of 3.55 mm and a total dimple volume of 345 $mm^3$.

The effective total volume is 272 $mm^3$ in both POP and PH.

The converted dimple depth is 0.228 mm at positions with an angle $\theta$ of up to 60 deg or 0.232 at positions with an angle $\theta$ of greater than 60 deg. Between POP and PH, the difference in carry is 0.2 m, and the difference in duration of flight is 0.02 sec.

The ball of Comparative Example 14 is identical with the fourth embodiment in dimple arrangement, dimple diameter and total dimple volume, but all the dimples have the same depth. Between POP and PH, the difference in carry is 1.2 m, and the difference in duration of flight is 0.06 sec.

The equal total effectiveness of dimple volume according to the fourth embodiment achieve an apparent effect.

We carried out further experiments and found that the variations in the aerodynamic characteristics due to the change of the axis of rotation of the ball are small insofar as the effective total dimple volume ratio is within 0.3%.

Therefore, good results will be given to the balls also having dimple arrangements other than those of the first to fourth embodiments in the above, when any one of the following requirements is satisfied.

* The dimple volume at positions with an angle $\theta$ of up 60 deg is 2 to 20% smaller than the dimple volume at positions with an angle $\theta$ of greater than 60 deg.

* The dimple volume gradually decreases toward each pole, and the volume of the dimple most proximate to the pole differs from that of the dimple most proximate to the parting line by 5 to 30%.

What is claimed is:

1. A golf ball comprising, a spherical surface, a plurality of dimples distributed over the spherical surface of the ball, a first axis (L2) passing through the center of the ball and defining two poles (P, P) at its intersection with the spherical surface, the dimples being symmetrically arranged in relation to a parting line (S) of the ball which is formed by the intersection of a plane passing through the center of the ball, said plane being perpendicular to the first axis and equidistant between the two poles, the dimples (D2) near a pole being smaller in volume than the dimples (D1) near the parting line, a total effectiveness of dimple volume in relation to the first axis (L2) being substantially equal to a total effectiveness of dimple volume in relation to a second axis (L1) passing through the center of the ball and being perpendicular to the first axis, wherein the effectiveness of dimple volume is defined as the product obtained by multiplying the volume of a dimple by the sine value of an angle made by a radius from the center of that dimple and the first or second axis of the ball.

2. A golf ball as defined in claim 1 wherein the volume of each dimple (D2) on the ball surface over an area thereof subtending an angle of 60 degrees at the center of the ball with respect to the line through the poles is 2 to 20% smaller than the volume of each dimple (D1) on the other area of the ball surface.

3. A golf ball as defined in claim 1 wherein the volume of the dimples decreases toward each pole, and the difference in volume between the dimple most proximate to the pole and the dimples most proximate to the parting line is 5 to 30%.

4. A golf ball as defined in claim 2 wherein the volume of the dimples decreases toward each pole, and the difference in volume between the dimple most proximate to the pole and the dimples most proximate to the parting line is 5 to 30%.

5. A golf ball as defined in claim 1 wherein each total effectiveness of dimple volume has variations falling within 0.3%.

6. A golf ball as defined in claim 5 which has 332 dimples in a substantially icosahedral arrangement.

7. A golf ball as defined in claim 5 which has 392 dimples in a substantially icosahedral arrangement.

8. A golf ball as defined in claim 5 which has 492 dimples in a substantially icosahedral arrangement.

9. A golf ball as defined in claim 1 which has 332 dimples in a substantially icosahedral arrangement.

10. A golf ball as defined in claim 1 which has 392 dimples in a substantially icosahedral arrangement.

11. A golf ball as defined in claim 1 which has 492 dimples in a substantially icosahedral arrangement.

* * * * *